United States Patent [19]

Massey et al.

[11] 4,364,740

[45] Dec. 21, 1982

[54] METHOD FOR REMOVING UNDESIRED COMPONENTS FROM COAL

[75] Inventors: Lester G. Massey, Cuyahoga County, Ohio; Robert I. Brabets, DuPage County; William A. Abel, Will County, both of Ill.

[73] Assignee: CNG Research Company, Cleveland, Ohio

[21] Appl. No.: 261,470

[22] Filed: Mar. 7, 1981

Related U.S. Application Data

[63] Continuation-in-part of PCT/US81/00273, Mar. 4, 1981, abandoned, which is a continuation-in-part of Ser. No. 127,740, Mar. 6, 1980, Pat. No. 4,313,737.

[51] Int. Cl.[3] ..... C10L 9/08; C10L 1/32; C10L 9/02

[52] U.S. Cl. ..... 44/1 C; 44/1 SR; 241/2; 241/24; 241/16

[58] Field of Search ..... 44/1 SR, 1 C, 51; 241/2, 17, 23, 24, 160; 209/160

[56] References Cited

U.S. PATENT DOCUMENTS

| | | | |
|---|---|---|---|
| 2,560,807 | 7/1951 | Lobo | 241/1 |
| 3,327,402 | 6/1967 | Lamb et al. | 34/9 |
| 3,660,054 | 5/1972 | Rieve | 44/1 SR |
| 3,756,791 | 9/1973 | Mancke | 44/1 SR |
| 4,014,104 | 3/1977 | Murphy | 34/9 |
| 4,030,893 | 6/1977 | Keller | 44/1 SR |
| 4,192,651 | 3/1980 | Keller | 44/1 SR |

OTHER PUBLICATIONS

H. H Lowry, Chemistry of Coal Utilization, pp. 237-252, (John Wiley & Sons, Inc., 1963).

Huffman, Garner and Parker, "Conversion of Coal with Methanol as Reactant", *Coal Processing Technology,* vol. 2, pp. 76-82, (AIChE, 1975).

Makabe and Ouchi, "Structural Analysis of NaOH—Alcohol Treated Coals", *Fuel,* vol. 58, (1/79).

Makabe, Hirano and Ouchi, "Extraction Increase of Coals Treated with Alcohol—Sodium Hydroxide at Elevated Temperatures", Fuel, 1978.

Bartle et al., "Structural Analysis of Supercritical—Gas Extracts of Coals", *Fuel,* vol. 58, (Jun. 1979).

Mortimer, "Thermal Behaviour of a Supercritical Gas Extract of Coal", *Fuel,* vol. 58, (Nov. 1980).

Makabe, Fuse and Ouchi, "Effect of the Species of Alkalai on the Reaction of Alcohol—Alkalai—Coal", *Fuel,* vol. 57, pp. 801-802, (12/78).

"Guide to Coal—Cleaning Methods", *Chem. Eg.,* pp. 47-49, (Jan. 26, 1981).

"A Contribution to the Knowledge of Coal Types", *Brennstoff—Chemie,* vol. 31, No. 7/8, pp. 103-111, (1950).

Dryden, "Solvent Power for Coals at Room Temperature", *Chem. & Ind.,* pp. 502-508, (Jun. 7, 1952).

Ross and Blessing, "Alcohols as H—Donor Media in Coal Conversion, 1. Base Promoted H—Donation to Coal by Isopropyl Alcohol", *Fuel,* vol. 58, (Jun. 1979).

Ross and Blessing, "Alcohols as H—Donor Media in Coal Conversion, 2. Base Promoted H—Donation to Coal by Methyl Alcohol", *Fuel,* vol. 58, (Jun. 1979).

Bartle et al., Aromatic Products of 340° C. Supercritical—Toluene Extraction of Turkish Lignites: An N.M.R. Study, *Fuel,* vol. 58, (Jun. 1979).

*Primary Examiner*—Carl F. Dees

*Attorney, Agent, or Firm*—Allegretti, Newitt, Witcoff & McAndrews

[57] ABSTRACT

A process is disclosed for treating a fluid-permeable hydrocarbonaceous solid, such as coal, containing an admixture of hydrocarbonaceous components and mineral and sulfur components, to separate the solid into a hydrocarbonaceous enriched fraction and a mineral and sulfur enriched fraction. The process involves comminuting the solid in the presence of a low molecular weight alcohol under conditions sufficient to substantially scission the hydrocarbonaceous components from the mineral and sulfur components and to selectively comminute the hydrocarbonaceous components. The resultant product is thereafter separated into the enriched hydrocarbonaceous fraction and the enriched mineral and sulfur fraction.

In a preferred embodiment of the process, the hydrocarbonaceous solid is mixed with a low molecular weight alcohol, such as methanol, to form a slurry. The slurry is then heated and pressurized to a temperature and pressure above the critical temperature and pressure of the alcohol. In particularly preferred form, the slurry is heated for a sufficient length of time to form: (1) a dissolved portion of the hydrocarbonaceous components in alcohol; (2) an undissolved suspended portion of hydrocarbonaceous material saturated with the alcohol; and (3) a discrete undissolved suspended portion of the mineral components. The superheated slurry is thereafter expanded, preferably by a substantially instantaneous adiabatic expansion, most preferably in the presence of a sulfur scavenger compound. The result is a selective precipitation, comminution and production of substantially mineral and sulfur free, ultra-fine hydrocarbonaceous particles in admixture with discrete relatively larger mineral particles.

48 Claims, 2 Drawing Figures

METHOD FOR REMOVING UNDESIRED COMPONENTS FROM COAL

BACKGROUND OF THE INVENTION

This is a continuation-in-part of application Ser. No. 127,740, filed Mar. 6, 1980 U.S. Pat. No. 4,313,737, by Massey et al., titled "Method For Separating Undesired Components From Coal By An Explosive Type Comminution Process" and of International Application No. PCT/US 81/00273, filed Mar. 4,1981, by Massey et al., titled "Method For Separating Undesired Components From Coal By An Explosive Type Comminution Process," the teachings of which are incorporated by reference herein.

The expanding need for energy combined with the depletion of known crude oil reserves has created a serious need for the development of alternatives to crude oil as an energy source. One of the most abundant energy sources, particularly in the United States, is coal. Estimates have been made which indicate that the United States has enough coal to satisfy its energy needs for the next two hundred years.

Much of the available coal, however, contains significant amounts of inorganic ash forming minerals and sulfur compounds in admixture with the hydrocarbonaceous component of the coal. These non-hydrocarbonaceous components create serious pollution problems when the coal is burned. The amount of sulfur and ash forming mineral components in coal varies greatly. However, virtually all types of coal contain such impurities and potential pollutants to some degree. As a result, expensive pollution control equipment is usually required as part of any installation using coal as a fuel. The added cost of acquiring and operating this equipment seriously detracts from and restricts the use of coal as an energy source.

Many techniques have been developed for converting coal into liquids or gases in order to reduce the pollution problems associated with the use of coal as a fuel. For example, one method of converting coal into a liquid is solvent extraction as practiced by the Pott-Broche process, developed during World War II and discussed in H. H. Lowry, *Chemistry of Coal Utilization,* pp. 249–250 (John Wiley & Sons, Inc. 1963).

Since the Lowry publication, other articles and reports have been written discussing the mechanism and effect of treating coal with tetralin, toluene or lower molecular weight alcohols such as methanol, ethanol and isopropanol at high temperature and pressure, e.g., 600° C. and 1400 psi. Such articles and reports include: (1) Huffman, Garner and Parker, "Conversion of Coal with Methanol as Reactant," *Coal Processing Technology,* Vol. 2 (A.I.ch.E 1975); Makabe and Ouchi, "Structural Analysis of NaOH—Alcohol Treated Coals," *Fuel,* Vol. 58 (Jan. 1979); Ross and Blessing, "Alcohols As H-Donor Media in Coal Conversion. 1. Base Promoted H. Donation to Coal By Isopropyl Alcohol," *Fuel,* Vol. 58 (June 1979); Ross and Blessing, "Alcohols As H-Donor Media in Coal Conversion. 2. Base—Promoted H. Donation to Coal By Methyl Alcohol," *Fuel,* Vol. 58 (June 1979); Bartle et al., "Aromatic Products Of 340° C. Supercritical—Toluene Extraction of Two Turkish Lignites: An N.M.R. Study," *Fuel,* Vol. 58 (June 1979); and "Guide to Coal-Cleaning Methods," Chem. Eg. 47–49 (Jan. 26, 1981).

A slightly different bituminous coal liquefaction process, disclosed in Stewart, Jr. et al., U.S. Pat. No. 3,850,738, involves combining coal with water at temperatures and pressures sufficient to thermally crack alkane bonds in the presence of hydrogen, converting the carbonaceous matter "to liquids, primarily aralkanes, gaseous hydrocarbons and undissolved ash." Still other techniques for using coal have involved mixing coal with various liquids such as methanol to form a stable slurry suspension that can be pumped and/or used directly as a fuel. See e.g., Keller U.S. Pat. No. 4,045,092; Stillman, U.S. Pat. No. 2,231,513; and Kiesskalt et al., U.S. Pat. No. 2,162,200.

Known methods for gasifying coal into methane, water gas or other combustible gases are represented by Sellers, U.S. Pat. No. 2,669,509. In Sellers, carbonaceous material is mixed with a fluid to form a suspension, which is then heated in turbulent flow sufficient to break up the carbonaceous particles, and the suspension is then mixed with oxygen at elevated temperatures sufficient to carry out a gasification reaction.

The inorganic ash forming minerals can frequently be partially removed from the products of the afore-mentioned processes, but the organic sulfur containing pollutants generally remain in the products. Such sulfurous compounds must be removed, if at all, by separate complex processing steps.

Another technique for increasing the availability and use of coal as a fuel involves the comminution of coal into fine particle size in an effort to separate the coal into its discrete component parts, e.g., hydrocarbonaceous matter and inorganic matter. One method of comminution, known as chemical comminution and illustrated in Aldrich et al., U.S. Pat. No. 3,850,477, involves weakening the intermolecular forces of the coal components by anhydrous ammonia or other suitable chemicals. Similar results are disclosed by W. Oversohl, "A Contribution To The Knowledge of Coal types." *Brennstoff—Chemie,* Vol. 31, No. 7/8, pp. 103–11 (1950), involving the contacting of coal with benzene at temperatures up to 300° C. or with a tetralin/cresol mixture at temperatures up to 420° C.

Other methods of comminution involve mechanical comminution, e.g., grinding, followed by further treatment to separate the hydrocarbonaceous components from the inorganic mineral components therein. In such method the grinding is effected by ball milling or jet milling or any other techniques wherein the coal particles impinge against or impact with a solid obstruction. Jet milling, for example, involves entraining coal particles in a gas stream, typically air, at high velocity and directing the gas stream against a solid obstruction. Examples of jet milling are shown and described in Switzer, U.S. Pat. No. 3,973,733, and Weishaupt et al., U.S. Pat. No. 3,897,010. Specific examples of jet milling devices include the "Micronizer" brand fluid energy mill manufactured by Sturtevant Mill Company and the "Jet-O-Mizer" fluid energy reduction mill produced by the Fluid Energy Processing and Equipment Company. These jet milling devices are described in an article, R. A. Glenn et al., *A Study Of Ultra-fine Coal Pulverization and its Application,* pp. 20, 90 (October 1963), distributed by the National Technical Information Service, U.S. Department of Commerce, 5285 Port Royal Road, Springfield, Va. 22151. Mechanical comminution techniques are frequently used, for example, to provide feed coal to a gasification reactor.

Ball milling, jet milling and other mechanical impingement techniques involve relatively crude forms of comminution having several disadvantages. For example, these techniques are relatively ineffective in directly separating the hydrocarbonaceous matter from the mineral matter because: (1) they do not comminute selectively, that is, they comminute the ash forming minerals as well as the valuable hydrocarbon portion of the coal; and (2) they do not sufficiently separate or scission the hydrocarbonaceous components from the inorganic mineral components of the coal, that is, the ash forming minerals generally remain physically attached to the hydrocarbonaceous material after the milling operation. As a result, the minerals thus comminuted cannot be effectively separated from the desired hydrocarbonaceous component. Moreover, the organic forms of sulfur remain chemically bonded in the hydrocarbonaceous matter and cannot be effectively separated therefrom. The mechanical comminution techniques are also limited in their degree of size reduction, i.e., mechanical techniques cannot effectively comminute coal to a mean particle size of less than about 5 microns[1] because of the inherent elasticity of the coal, and they cannot economically comminute the coal to a mean particle size of less than about 8 microns because of the energy costs involved.

As used herein, a micron is equivalent to a micrometer, or $10^{-6}$ meter (39.4 millionths of an inch).

A third comminution method involves the explosive comminution of coal. This method, which utilizes the fact that coal is a permeable porous or microporous friable solid, involves creating strong internal stress within the coal by forcing a fluid into the pores and/or micropores of the solid material at elevated temperature and/or pressure and then subjecting the material to rapid depressurization. The fluid within the pores and micropores thus expands very rapidly, thereby rupturing or exploding the coal into smaller particles. The explosive comminution of solid materials has been investigated in connection with various fluids, temperatures, pressures, and operating designs. E. G., Singh, U.S. Pat. No. 2,636,688; Kearby, U.S. Pat. No. 2,568,400; and Yellott, U.S. Pat. No. 2,515,542 describe the use of air or steam as the comminuting fluid in connection with pressures between about 15 and about 750 pounds per square inch absolute (psia) and temperatures below the softening point of the coal. Schulte, U.S. Pat. No. 3,342,498; and Schulte, U.S. Pat. No. 3,545,683 describe the use of gases such as steam or ammonia at pressures between about 500 and about 3,000 psia and temperatures between about 100° F. and about 750° F., not to comminute coal but to shatter ores. Lobo, U.S. Pat. No. 2,560,807; and Dean et al., U.S. Pat. No. 2,139,808 describe the use of a pressurized liquid such as water, preferably below about 200 psia. Stephanoff, U.S. Pat. No. 2,550,390 describes an explosive comminution reactor producing a product with a mean particle diameter of about 24 microns which is combined with a jet milling reactor to produce a final product with mean particle diameter of about 5 microns. Alternative explosive comminution techniques are described in Snyder, U.S. Pat. No. 3,895,760, and Ribas, U.S. Pat. No. 3,881,660.

The Jet Propulsion Laboratory in Pasadena, California has conducted research on the feeding of coal into high pressure reactors. This research involves plasticizing solid coal at high temperatures and pressures, then screw extruding the resultant mass at high temperature through a nozzle. Fine particles are, as a result, sprayed into a reactor. This work is described in "Technical Support Package on Screw-Extruded Coal, Continuous Coal Processing Method and Means", NASA Tech. Brief, Winter 1977 (updated April 1978), Vol. 2, No. 4, Item 33, prepared by W. P. Butler.

The present inventors have previously described an explosive comminution technique for converting the hydrocarbonaceous components in coal into discrete particles having a mean volumetric diameter of less than about 5 microns without substantially altering the size of the mineral components in the coal. Specifically, co-pending Application Ser. No. 127,740, filed Mar. 6, 1980, by Massey et al., titled "Method For Separating Undesired Components From Coal By An Explosive Type Comminution Process", teaches first forming a slurry of coal and a fluid, such as water, then heating and pressurizing the slurry to temperatures and pressures in excess of the critical temperature and critical pressure of the fluid. The resulting supercritical slurry is then passed to an expansion zone having a temperature and a pressure below the critical temperature and pressure of the fluid, and subsequently to a separation zone. This invention has many advantages over the prior art, e.g., eliminating ash forming minerals and reducing sulfur content. The present invention provides an improved technique for separating the mineral components from the valuable hydrocarbonaceous components and producing a transportable fluid fuel though the utilization of fluids generally contemplated by but not specifically disclosed in co-pending Application Ser. No. 127,740.

SUMMARY OF THE INVENTION

One object of the present invention is to provide a process for increasing the usefulness of coal as a fuel material.

Another object of the present invention is to provide an improved process for separating a porous hydrocarbonaceous solid, such as coal, containing an admixture of hydrocarbonaceous components and mineral components into a hydrocarbonaceous enriched fraction and a mineral enriched fraction.

Yet a further object of the present invention is to provide an improved process for selectively converting the hydrocarbonaceous material within a porous or fluid-permeable normally insoluble hydrocarbonaceous solid, such as coal, into a product of discrete ultrafine hydrocarbonaceous particles without affecting the mineral matter contained within the hydrocarbonaceous solid.

Yet still a further object of the present invention is to provide a method for removing organic forms of sulfur from coal.

We have discovered a novel and improved method of treating coal with a low molecular weight alcohol to produce improved and useful carbonaceous fuel products. Specifically, in a broad embodiment the hydrocarbonaceous material is admixed with a low molecular weight alcohol, e.g., an alcohol that is preferably monohydroxy and has about 1, 2 or 3 carbon atoms, most preferably methanol, to form a slurry. The slurry is then heated and pressurized to a supercritical temperature and pressure. In a preferred form, the slurry is pressurized prior to heating to a pressure at least as great as the critical pressure of the alcohol. By this pressurization step, the slurry liquid is prevented from "evaporating" during the heating step, i.e., the slurry is maintained in a substantially liquid state until the temperature of the alcohol is raised above the critical temperature of the alcohol, at which point the slurry changes from a liquid state directly to a supercritical state.

Thereafter, the slurry is subjected to a flash expansion. This flash expansion produces a selective precipitation and an explosive comminution of the hydrocarbonaceous components. As a result, the hydrocarbonaceous components are reduced to ultrafine particles without substantially affecting the nonporous mineral components in the coal. More specifically, this expansion technique presents a method for separating a porous hydrocarbonaceous solid containing an admixture of hydrocarbonaceous and nonporous mineral components into an enriched hydrocarbonaceous fraction and an enriched mineral fraction.

The use of lower weight alcohols, as opposed to water, produces a substantially improved product. Although the mechanism by which this improved process operates is not fully understood, it is believed that the alcohol interacts with the coal in a way which is not possible for water and may involve a hydrogen donor reaction. According to the present invention, the alcohol-coal slurry is maintained in the supercritical state, i.e., at a temperature and pressure above the critical temperature and critical pressure of the alcohol, for sufficient length of time prior to expansion to allow the supercritical fluid to saturate the pores of the hydrocarbonaceous material and to achieve the desired degree of interaction with the hydrocarbonaceous components therein, i.e., between about 5 seconds and 5 minutes, preferably between about 10 and about 20 seconds. At equilibrium the resulting supercritical slurry is believed to include: (1) a dissolved portion of the hydrocarbonaceous components in supercritical alcohol; (2) an undissolved suspended portion of the hydrocarbonaceous solid saturated with supercritical alcohol; and (3) a discrete undissolved suspended portion of the mineral components. The slurry is then passed in a substantially instantaneous manner from the supercritical state into an expansion zone having a temperature and pressure below the critical temperature and critical pressure of the alcohol.

The dissolved portion of the hydrocarbonaceous components is flash precipitated into discrete hydrocarbonaceous particles, while the discrete undissolved suspended portion of the mineral components is substantially uneffected. With respect to the undissolved suspended portion of the hydrocarbonaceous solid, the supercritical fluid within the pores of the solid provides a pressure differential between the pores and the surface of the solids sufficient to comminute the hydrocarbonaceous components of the solids selectively and to scission the hydrocarbonaceous components therein from the mineral components without comminuting the mineral components.

Further, interaction of the coal with the supercritical alcohol is believed to reduce the size of the undissolved suspended portion of the hydrocarbonaceous solids, with the ensuing explosive comminution producing a still further selective comminution of the undissolved suspended hydrocarbonaceous particles. Applicant has found that such selective size reduction seems to directly improve the degree of scissioning of mineral from hydrocarbonaceous particles. That is, hydrocarbonaceous particles less than about 2 microns in diameter have virtually no mineral compounds attached. Therefore the use of methanol, by unexpectedly improving the selective comminution of the hydrocarbonaceous components, significantly improves the process' ability to separate the valuable hydrocarbonaceous matter from the less valuable polluting mineral matter.

The product resulting from the explosive comminution of this invention is an admixture of discrete hydrocarbonaceous particles of ultrafine size and discrete mineral particles of diameter substantially unchanged from their original size. The mean volumetric diameter of the discrete hydrocarbonaceous particles is less than about 5 microns, preferably less than about 3 microns, and most preferably between about 1 and about 0.1 micron, and the mean volumetric diameter of the mineral particles both before and after the process is generally between about 5 and about 9 microns. This selective particle size reduction of the hydrocarbonaceous components in combination with the differences in density between the hydrocarbonaceous particles and the mineral particles permits the discrete hydrocarbonaceous particles to be separated from the discrete mineral particles, preferably by gravity separation techniques well known to those of skill in the art, to provide an enriched hydrocarbonaceous fraction and an enriched mineral fraction. The enriched hydrocarbonaceous fraction has a mineral content substantially reduced from the original coal, e.g. preferably between about 70 and about 95 weight percent of the mineral components in the coal are removed to define the enriched hydrocarbonaceous fractions. The enriched mineral fraction contains the majority of the minerals originally present in the coal solids.

Highly volatile sulfur containing vapors are generated when the slurry is heated to between about 600° F. and about 850° F. and before the slurry is passed to sudden expansion. These vapors are believed to be generated from the organic forms of sulfur that are present in the hydrocarbonaceous material. In a preferred embodiment, the slurry or the highly volatile sulfur containing vapors are contacted with a sulfur scavenging agent, preferably a conventional sulfur scavenging agent such as calcium oxide or ferric oxide. The organic sulfur compounds in the hydrocarbonaceous material are effectively eliminated from the coal and coal products in this manner.

As indicated, according to the present invention the slurry should be heated to above the critical temperature and critical pressure. Such supercritical conditions are necessary for two reasons. First, the hydrocarbonaceous solids, such as coal, were previously believed insoluble in low molecular weight alcohols. It has been found in connection with this invention, however, that the hydrocarbonaceous components of the coal are believed to become relatively soluble in the low molecular weight alcohol at supercritical conditions. Importantly, the mineral components remain insoluble even at the supercritical conditions. As a result, the liquid portion can be removed from the mineral components, thus allowing for the hydrocarbonaceous components to be thereafter selectively precipitated from the alcohol. Moreover, the interaction between the hydrocarbonaceous components and the low molecular weight alcohol at supercritical conditions results in a substantial portion of the hydrocarbonaceous components (e.g., between about 10 and about 20 percent by weight of the coal solids) remaining soluble in the alcohol even after the alcohol solution is returned to ambient conditions. The result is a liquid fuel solution of alcohol and dissolved hydrocarbonaceous matter, free of mineral matter. Second, supercritical conditions should be attained so that the explosive comminution aspect of the process is facilitated by maintaining the alcohol in the coal pores as a dense, high energy fluid. The dense fluid forms a column of fluid mass within the pores of the coal, the inertia of which is sufficient to prevent the fluid from gradually escaping the pores during the extremely rapid, e.g. instantaneous, depressurization. As a result, when the fluid expands rapidly, if not instantaneously, the pressure differential causes the coal to literally explode. Less energy intensive fluids, e.g., liquid or vapors at subcritical temperatures and pressures, do not have sufficient energy to adequately provide this effect.

As used in the description of the present invention, the "critical point" of an alcohol refers to the temperature and pressure at which the vapor phase and the liquid phase of the alcohol can no longer be distinguished, i.e. the phases merge. "Critical temperature" refers to the temperature of the alcohol at the critical point, that is, the temperature above which the alcohol cannot be liquefied at any pressure. "Critical pressure" refers to the vapor pressure of the alcohol at the critical temperature. "Critical phenomena" refers to the physical properties of the supercritical phase alcohol at or above the critical point. An alcohol which has been pressurized above its critical pressure and heated above its critical temperature will be referred to as a "supercritical fluid" or as being in a "supercritical state." The critical point of pure methanol occurs at about 1175 psia and about 462° F.

"Mean volumetric diameter" as used herein refers to the average diameter of a group or class of particles calculated based upon an average volume of the particles within the group or class. This concept is more fully explained in the referenced co-pending application of Massey et al., Ser. No. 127,740, the teachings of which are incorporated herein by reference. Other terms, including "explosive comminution", "selective comminution" and "scissioning" have been referred to and briefly defined herein.

DESCRIPTION OF THE DRAWING

In the detailed description that follows reference will be made to the drawing comprised of the following figures.

DESCRIPTION OF THE PREFERRED EMBODIMENT

As previously noted, this invention provides a method of treating hydrocarbonaceous material which contains a mixture of hydrocarbonaceous components and mineral components to increase the usefulness of the hydrocarbonaceous material as a fuel. Coal is the preferred hydrocarbonaceous material to be used in connection with this invention, although other hydrocarbonaceous materials such as oil shale, tar sands, peat, etc., may be used. While advantageous results are obtained in connection with the use of virtually all known coal types, preferred for use herein are bituminous and sub-bituminous coals wherein the hydrocarbonaceous component comprises between about 70 and about 85 percent by weight of the coal, and the mineral component comprises between about 15 and about 30 percent by weight. The moisture present in coal can contribute to chemical degradation of the alcohol at high temperatures and pressures. As a result, although the process of this invention can utilize coal containing substantially any naturally occurring moisture content, it is believed preferable that the water or moisture content of the coal comprises between about 3 and about 10 percent by weight of the coal. In a preferred embodiment, this invention teaches a technique for removing organic and inorganic forms of sulfur from coal; the coal preferaby used in connection with this embodiment contains sulfur compounds in the amount of between about 2 and about 6 percent sulfur by weight of the coal.

Figure 1:
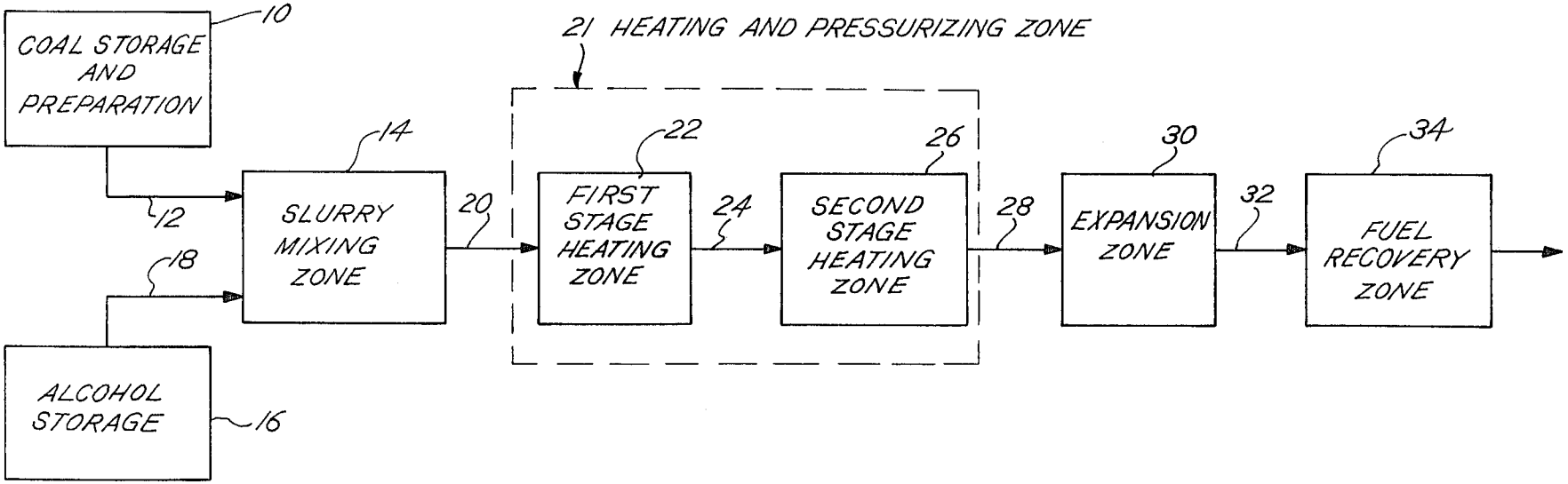
FIG. 1 is a simplified block diagram illustrating the process.

Referring to FIG. 1, the simplified block type diagram therein shows that the invention includes a coal storage and preparation area 10, a slurry mixing zone 14, an alcohol storage area 16, a heating and pressurizing zone 21, an expansion zone 30 and a fuel recovery zone 34.

More specifically, the coal or hydrocarbonaceous material used in connection with the invention is transferred from the coal storage and preparation area 10 through a line 12 to the slurry mixing zone 14 where it is combined with alcohol received from the alcohol storage area 16 via line 18, thus forming a slurry of alcohol and hydrocarbonaceous material. The admixture of the coal and the alcohol may be accomplished in any of several ways well known to one of ordinary skill in the art which result in a fluid mixture of coal suspended in alcohol, i.e., a true coal-alcohol slurry.

The alcohol used in connection with this invention is one in which the hydrocarbonaceous material is substantially insoluble at ambient or moderately elevated temperatures (e.g., below the critical point) and in which, it has now been discovered, at least a portion of the hydrocarbonaceous component of the coal becomes soluble at temperatures and pressures above the critical point while the mineral component of the coal remains substantially insoluble at conditions above the critical point. In has been found that low molecular weight alcohols are suitable for use in connection with this invention, preferably monohydroxy alcohols having between 1 and about 3 carbon atoms, e.g., methanol, ethanol, propanol and isopropanol, most preferably methanol.

The relative amounts of alcohol and coal combined to form the slurry may vary. Preferably, the coal solids comprise from between about 10 or less percent to about 65 percent by weight of the total slurry. More preferably, the coal solids content of the slurry is as high as possible, preferably between about 50 and about 65 percent by weight of the total slurry. High coal solids contents are preferred because they increase the energy efficiency of the operation. One significant advantage of using alcohol to form the slurry over the use of water is that a higher weight percent of coal solids can be slurried in alcohol than in water while maintaining the slurry as a pumpable fluid at room temperature. That is, coal-fluid slurries are highly thixotropic, particularly at high coal solids contents. Presently available pumping systems are unable to pump coal-water slurries of greater than about 50 weight percent coal solids, but those same pumping systems can pump the coal-alcohol slurries at coal solids contents up to about 65 weight percent coal solids.

The slurry from mixing zone 14 is passed by way of a line 20 to a heating and pressurizing zone 21 wherein the temperature and pressure of the slurry are raised to supercritical conditions. The heating of the slurry can be accomplished in one or in several steps. The heating should be rapid in order to avoid "cooking" the slurry, which is believed to lead to chemical decomposition of the alcohol. Apparatus suitable for rapid single stage heating is more fully described in a copending application, Ser. No. 127,736, filed Mar. 6, 1980, by Massey et al., titled "Method and Apparatus for Heating Liquids and Agglomerating Slurries."

The heating and pressurizing is preferably accomplished in such a way that the vapor pressure of the liquid does not exceed the pressure imposed by the process in order to thereby avoid vaporization of the liquid. For example, the slurry is initially pressurized to final operating pressure and, thereafter, heated to operating temperature. In an embodiment more fully described hereinafter, heating and pressurizing zone 21 comprises a first stage heating zone 22 and a second stage heating zone 26 connected by a line 24.

In first stage heating zone 22 the slurry is heated to a temperature of less than about 400° F. at a rate of between about 15 and about 40 BTU per pound of slurry per minute. The rate of heating in the first stage of heating zone 22 is sufficient to heat the slurry to the final first stage temperature within about 10 minutes or less, assuming the slurry is originally at ambient conditions. It has been found in connection with the present invention that the highest temperature reached in the first stage heating zone 22, i.e., the final first stage temperature, is desirably less than about 400° F., preferably between about 300° and about 400° F. The technique used for the first stage heating zone 22 may be any of several techniques known to one of ordinary skill in the art, e.g., a tube-in-shell heat exchanger or direct fired boiler. Preferably the technique for first stage heating 22 avoids "hot spots" within the slurry which tend to agglomerate the coal solids.

After the slurry has reached a final first stage temperature in first stage heating zone 22, the slurry is passed through line 24 to a second stage heating zone 26. There the slurry is further heated at a rate of between about 250 and about 500 BTU per pound of slurry per minute to a final second stage temperature above the critical temperature of the alcohol and between about 700° F. and about 850° F., i.e., sufficient to heat the slurry within less than about 30 seconds, preferably within between about 15 and about 30 seconds. It is important that the final second stage temperature of the slurry be above about 700° F. in order to provide the desired high level of solubility of the hydrocarbon components in the alcohol and to provide the high energy level of the supercritical fluid necessary to explosively comminute the undissolved coal solids in the preferred manner to be explained hereinafter. It is important that the final second stage temperature of the slurry not go above about 850° F. for long time periods because it is believed in accordance with this invention that the alcohol begins to rapidly decompose. The rate of heating provided by the second stage heating zone 26 should be kept within the indicated high rate so that the slurry is heated rapidly and the chemical breakdown of alcohol is minimized.

In a batch process application of the present invention, heating of the slurry to supercritical conditions can be accomplished in a substantially isochoric manner. As used herein, "substantially isochoric manner" means that the slurry is heated in a substantially constant volume environment. In a preferred batch process, the slurry is heated in an enclosed container. As the temperature of the slurry rises, the pressure in the container also rises in correspondence to the increasing vapor pressure of the alcohol. In general, in an enclosed container, there will be a space or air pocket above the slurry. To the extent that such an air pocket exists, the container allows a small volumetric expansion of the slurry, and the heating is not strictly isochoric. The important point with respect to the practice of the invention, however, is that the pressure within the container exceeds critical pressure once the temperature of the slurry within the container exceeds critical temperature, and, preferably, that as the slurry is heated, the pressure in the container remains at or above the vapor pressure of the alcohol. When the "air pocket" is sufficiently small, the heating of the slurry in accordance with this invention from ambient to supercritical conditions creates a large pressure increase in the container, and the volumetric expansion which may occur due to the air pocket is of a relatively minor nature, e.g., it accounts for less than about 0.05 percent of the final slurry pressure. In such instance the heating is believed properly characterized as "substantially isochoric" notwithstanding a small volumetric expansion allowed by the air pocket.

In the continuous process of the present invention, shown in FIG. 2 and explained in detail hereinafter, the slurry is pressurized to a high pressure above the critical pressure of the slurry prior to the second stage heating, and high pressure is maintained throughout the second stage heating. In preferred form, the slurry is pressurized to between about 3000 and about 15,000, preferably between about 5,000 and about 10,000 psia. The continous process is generally characterized by a substantially isobaric, or constant pressure, manner of heating. Although some pressure drop occurs across the system, the amount of this pressure drop is small in comparison to the system operating pressure, e.g., less than about five (5) percent and preferably less than about one (1) percent, such that the process is believed accurately characterized as substantially isobaric. The pressure drop does not adversely effect the system operation as long as the pressure does not drop below the alcohol's critical pressure.

It is believed in connection with the present invention that, whereas substantially none of the hydrocarbonaceous material is soluble in the alcohol at ambient or conventional elevated conditions, i.e., high temperature liquid or gaseous vapor states, the hydrocarbonaceous component in the coal is dissolved in the supercritical phase alcohol. However, the mineral components in the coal remain insoluble, even in supercritical phase alcohol. As a result, in supercritical phase, the slurry is believed to comprise a supercritical fluid having at least a portion of the hydrocabonaceous component of the coal dissolved therein, at least a portion of the mineral component in coal (previously associated with the now dissolved hydrocarbonaceous portion) suspended as discrete particles in the supercritical fluid, and the undissolved portion of the hydrocarbonaceous material also in suspension.

Following heating of the slurry in the second stage heating zone 26, the slurry is passed by a line 28 to an expansion zone 30 wherein the slurry is adiabatically expanded and, as a result, its temperature drops to less than about 450° F. It is advantageous that the length of time between achieving supercritical conditions and expansion be relatively short, i.e., generally between about 5 seconds and 5 minutes, preferably between about 10 and 20 seconds, because otherwise excessive decomposition of the supercritical alcohol results.

The adiabatic expansion occurs substantially instantaneously, e.g. within less than about 100 microseconds, preferably less than about 10 microseconds, more preferably less than about 1 microsecond, and, still more preferably, less than about 0.1 microsecond.

As a result of the expansion step, the supercritical alcohol flashes and hydrocarbonaceous components that were dissolved in the alcohol are precipitated as discrete ultrafine hydrocarbonaceous particles. Moreover, the rapid expansion of the supercritical alcohol within the pores of the undissolved coal solids causes a pressure differential between the pores and the surface of the coal solids sufficient to selectively comminute the hydrocarbonaceous components of the coal into ultrafine particle size and to scission the hydrocarbonaceous components from the mineral components. Since the mineral components are relatively hard and non-porous, the changes within the expansion zone take place without substantial comminution of the mineral components present, and the mineral components are substantially unaffected by the flash expansion. The resulting product is an admixture of discrete ultrafine hydrocarbonaceous particles and discrete mineral particles, the admixture being suspended in alcohol vapor. The discrete ultrafine hydrocarbonaceous particles have a mean volumetric diameter less than about 5 microns, preferably less than about 3 microns, and most preferably less than about 1 micron. This size is substantially smaller than any size achieved by the prior art, even that utilizing the previous discovery by these same inventors disclosed in Ser. No. 127,740. As noted, the mean volumetric particle diameter of the discrete mineral particles is substantially unchanged from their natural state, i.e. between about 5 and about 9 microns. The admixture that results from the expansion step may be referred to as the resultant or shattered product.

The pressure in the expansion zone 30 may be substantially any pressure below the critical pressure of the alcohol, but preferably the pressure is about ambient pressure. The temperature in the expansion zone 30 similarly may be any temperature below the critical temperature of the alcohol, but is preferrably above the dew point of the alcohol at the existing pressure in order to avoid condensation of the alcohol. Condensation of any liquid phase within the expansion zone 30 may tend to cause the hydrocarbonaceous component and the mineral components to agglomerate complicating further separation of the valuable hydrocarbonaceous component. In preferred form, the temperature within the expansion zone 30 is between about 200° F. and about 275° F.

The reaction mixture is then passed from expansion zone 30 via line 32 to fuel recovery zone 34 where the hydrocarbonaceous particles are separated from the discrete mineral particles according to any of several techniques known to one of ordinary skill in the art, e.g., cyclone separation, or flotation. The sulfur scavenging agent, the suspended mineral components and other suspended matter are removed to provide a first fraction enriched in hydrocarbonaceous particles and a second fraction enriched in mineral particles. Between about 70 and about 95 percent by weight of the mineral components present in the original coal solids is removed from the hydrocarbonaceous enriched fraction, preferably between about 85 and 95 percent.

Figure 2:
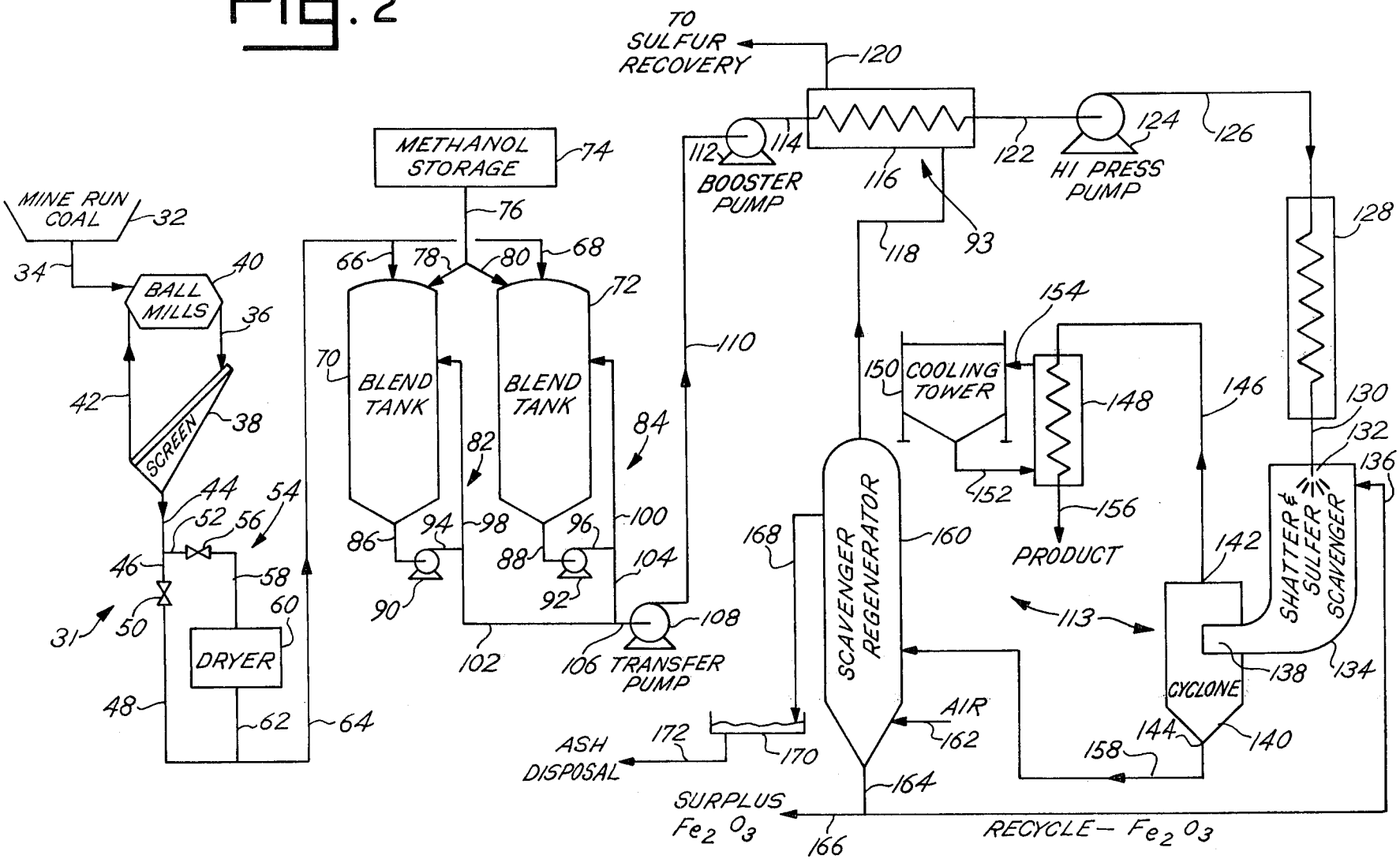
FIG. 2 is a detailed schematic view illustrating a preferred embodiment of the invention shown in FIG. 1.

Referring now to FIG. 2, the schematic representation of a continuous process of the present invention shown therein includes a slurry preparation area 31, a slurry heating area 93, and a coal shattering and product recovery area 113. The slurry preparation area 31 includes hopper 32, screens 38, grinder 40, dryer 60, blend tanks 70, 72, circulating pumps 90, 92, and numerous connecting lines. The slurry heating area 93 includes booster pump 112, first stage heater 116, high pressure pump 124, second stage heater 128 and a variety of connecting lines. The coal product and recovery area 113 includes expansion orifice 132, expansion zone 134, cyclone separating device 140, condenser 148, cooling tower 150, and regenerator 160.

Referring to preparation area 31, the hydrocarbonaceous material, or mine run coal, is received in a hopper 32 and transferred from there by line 34 to a grinder 40. The grinder 40 is preferably a ball mill, but may alternatively be any of several designs known to one of ordinary skill in the art, e.g. rollers or jet mills.

The coal is initially comminuted in grinder 40 to less than about 150 microns in diameter. The coal is than passed by line 36 to a screen 38 preferably of about 100 mesh size where oversized coal, e.g. coal of greater than about 150 microns in diameter, is separated and returned by line 42 to the grinder 40 for further comminution.

The hydrocarbonaceous material processed in connection with this invention generally comprises between about 3 and about 10 percent weight by moisture. Some forms of coal contain considerably higher amounts of moisture, e.g. up to 40 percent by weight moisture. Moisture contents greater than about 5 percent by weight may affect the operation of the invention by promoting undesirable interaction with the coal and, at moisture contents greater than about 10 percent by weight, with the slurry liquid itself at high temperatures. In order to provide for preprocessing coal with unacceptably high moisture content, line 44 is preferably also connected to alternate drying loop 54 between the screen 38 and the blending tanks 70 and 72. Alternative drying loop 54 includes line 52, valve 56, dryer 60, and lines 58 and 62, as well as bypass lines 46,48 and valve 50. In this manner, if it is determined that the mine run coal contains acceptable amounts of moisture, valve 50 can be opened, valve 56 closed and the ground coal transferred to the blending tanks 70 and 72 through lines 46, 48, 64, 66 and 68. Alternatively, if it is determined that the ground coal contains unacceptable amounts of moisture, valve 56 can be opened, valve 50 closed, and the coal directed through dryer 60 in order to remove excessive moisture.

Coal which has the desired moisture content is passed through lines 64, 66, and 68 into dual blending tanks or mixing tanks 70, 72 respectively. Alcohol is added to the blending tanks 70, 72 from a methanol storage tank 74 via lines 76, 78, 80. The coal and methanol within the blending tanks 70, 72 are continuously circulated through circulating loops 82 and 84, respectively. The circulating loops 82, 84 include circulating pumps 90, 92 and additional lines 86, 88; 94, 96; and 98, 100 respectively. The continuous circulation of the methanol and coal through the loops 82 and 84 provides a mixing and stirring action sufficient to produce a methanol-coal slurry of substantially uniform composition. In one embodiment, about 40,000 pounds of coal is mixed with about 38,500 pounds of methanol per day to form a slurry of about 51 percent solids content.

A transfer pump 108 is preferably connected to the circulating loops 82, 84 via draw lines 102, 104, and 106. The transfer pump 108 draws a slurry mixture off of the circulating loops 82, 84 and transfers the slurry through line 110 to a booster pump 112. The booster pump 112 raises the pressure of the slurry to a first predetermined level prior to the first stage heating. Slurry is passed from the booster pump 112 at about 70° F., or ambient temperature, through a line 114 to a first stage heater 116. The pressure imposed upon the slurry by the booster pump 112 is generally any pressure which is above the vapor pressure of the slurry reached during first stage heating, preferably about 600 psia.

The first stage heater 116 heats the slurry, raising its temperature in a continuous "flow through" process to a temperature of less than about 400° F., preferably between about 300° and 400° F. The design of first stage heater 116 may be any of several designs known to one of ordinary skill in the art, as previously noted, but is preferably a tube-in-shell heat exchanger wherein the heating medium comprises an exhaust gas received from a subsequent stage of the process, explained hereinafter, which is passed through the first stage heater 116 by lines 118 and 120. The exhaust gases generated in the manner hereinafter described are sufficient to raise the temperature of the slurry in the first stage heater 116 to about 300° F. within about 10 minutes. The pressure existing in first stage heater is substantially constant, and primarily determined by the booster pump 112. Although the pressure in the first stage heater is substantially constant, the volume of the slurry may expand as it is heated, a fact which is reflected in an increased or more rapid volumetric flow.

The slurry, at about 380° F. and 600 psia, is passed by line 122 to a high pressure pump 124 wherein the pressure of the system is raised to a predetermined high level substantially above the critical pressure of the alcohol. The high pressure pump is preferably of a type designed to pump coal-fluid slurries at high velocities under high pressures, such as the pump taught in a co-pending application Ser. No. 127,738, filed Mar. 6, 1980, by Massey et al., titled "System For Pumping Fluids At Constant Pressure," the teachings of which are incorporated herein by reference. As noted previously, the critical pressure of methanol is about 1175 psia. The pressure imposed by high pressure pump 124 in accordance with this invention is generally between about 1500 and 15,000 psia, preferably between 3000 and about 10,000 psia. This level is sufficient to maintain a supercritical fluid density sufficient to facilitate solubility of the hydrocarbonaceous components in the supercritical fluid and to provide the high energy needed for explosive comminution according to the present invention. In a preferred embodiment the slurry is pressurized by high pressure pump 124 to about 5,000 psia.

The high pressure, moderately high temperature slurry is transferred from the high pressure pump 124 through a line 126 to the second stage heater 128. The temperature of the slurry is thereby rapidly raised in the second stage heater 128 from about 380° F. to a predetermined final second stage temperature above the critical temperature of the alcohol and preferably between about 600° F. and about 900° F., most preferably between about 700° F. and about 850° F. In one preferred embodiment, the methanol coal slurry is raised to about 700° F. in about 30 seconds.

The supercritical fluid is passed from second stage heater 128 by a line 130 through an adiabatic expansion orifice 132 into an expansion chamber 134. The expansion orifice 132 and expansion chamber 134 should be of the type which maximizes comminution of the hydrocarbonaceous components while minimizing comminution of the mineral components, such as the orifice and expansion chamber described in a co-pending application Ser. No. 127,739, filed Mar. 6, 1980, by Massey et al., titled "Adiabatic Expansion Orifice Assembly And A Process For Passing A Slurry From A High Pressure Region To A Low Pressure Region," the teachings of which are incorporated herein by reference. In a preferred embodiment contemplated by the invention, the pressure and temperature within the expansion device 134 are about 20 psia and about 250° F., respectively. The expansion orifice 132 provides for substantially immediate adiabatic transfer of the supercritical slurry mix from the high energy supercritical state to the relatively low energy conditions within the expansion chamber 134. The rapid pressure drop associated with the adiabatic expansion of the slurry causes a substantially instantaneous flashing of the fluid. As noted, the portion of the hydrocarbonaceous component which was dissolved in the supercritical fluid is precipitated as discrete substantially pure ultrafine hydrocarbonaceous particles, and the undissolved portion of the solid coal particles which was suspended in the supercritical fluid is explosively and selectively comminuted by the expanding fluid to produce additional discrete substantially pure ultrafine hydrocarbonaceous particles. As a result of the interraction of the coal and the supercritical alcohol, the discrete hydrocarbonaceous particles are produced in unusually ultrafine particle size, generally having a mean volumetric diameter of between about 0.1 and about 3 microns, preferably between about 0.1 and about 1 microns. The size of the discrete mineral particles is substantially unchanged, so that they are present in mean volumetric diameter of about between 5 and about 9 microns.

It has been discovered that the selective comminution of the hydrocarbonaceous matter to particles less than about 2 microns results in a substantially complete scissioning of the hydrocarbonaceous matter from the mineral matter. The process of this present invention surprisingly produces such a selective comminution of the hydrocarbonaceous matter more effectively than any known process, including that described by these same inventors in Ser. No. 127,740. This invention, therefore, produces hydrocarbonaceous matter separable from the mineral matter more effectively than any other method known to the prior art.

When the slurry is brought to temperatures above 600° F. two chemical reactions are believed to take place, resulting in the production of highly volatile sulfur containing vapors. First, the complex organic forms of sulfur decompose to simpler, volatile sulfides, e.g., hydrogen sulfide and methyl mercaptan. The pyrite portion of the mineral matter reacts with alcohol and the small residue of water present to form iron oxide and hydrogen sulfide. These reactions are reversed when the temperature is suddenly lowered to about 200°-250° F.

Since the sulfur containing vapors are believed to derive from the organic and inorganic forms of sulfur contained within the coal, contacting the sulfur containing vapors with the sulfur scavenging agent while the slurry is at temperatures above about 200° F. to about 300° F. effectively isolates and allows for thereafter eliminating the sulfur compounds by methods which will be more fully described hereinafter.

In preferred form, the sulfur scavenging agent comprises particles between about 10 and about 100 microns in diameter of a compound such as calcium oxide (CaO) or iron oxide. Between about 5 and about 50 pounds of sulfur scavenging agent should be contacted with the slurry for each pound of sulfur indicated by analysis to be organically and inorganically combined in the hydrocarbonaceous solid. The theoretical minimum weight ratio of sulfur scavenger to sulfur required is determined by the availability of reactant surface area.

The sulfur scavenging agent is preferably introduced at the expansion orifice to react with the sulfurous vapors while they are between 200° and 300° F., and thereby convert them to dense solid mineral sulfides. In particularly preferred form, a sulfur scavenging agent is sprayed into the expansion chamber 134 by line 136 at a point immediately adjacent the expansion orifice 132 such that the sulfur scavenging agent contacts the slurry solids immediately after they have passed the orifice and entered the expansion zone. The sulfur scavenging agent combines with the sulfur compounds, or more specifically with the sulfur containing vapors produced by the slurry, to form a relatively nonreactive inorganic sulfur compounds which will not thereafter recombine with the hydrocarbonaceous material. In this way, substantially all of the organic forms of sulfur and significant amounts of the mineral sulfur compounds effectively are isolated from the hydrocarbonaceous matter, and are subsequently removed in a manner to be explained shortly.

The product from the expansion chamber 134 comprises discrete hydrocarbonaceous particles, discrete inorganic mineral particles derived from the mineral components of the coal and discrete inorganic mineral particles derived from the sulfur scavenging agent, all of which are in suspension in the alcohol vapors. This product is passed from the expansion chamber 134 through an inlet 138 into a cyclone separating device 140.

The cyclone 140 includes, in addition to fluid inlet 138, a fluid outlet 142 and a particle outlet 144. The flow of product from expansion chamber 134 into cyclone 140 creates a vortex flow which separates vapor and smaller solid particles of predetermined size. More specifically, the cyclone 140 is designed according to techniques well known to one of ordinary skill in the art to separate vapor and solid particles smaller than about three microns in diameter from particles larger than about three microns in diameter. The sub-3 micron size particles are entrained along with the alcohol vapor and carried out fluid outlet 142. The particles larger than about 3 microns in diameter are removed from the cyclone via particle outlet 144.

The overflow from the cyclone 140, i.e. the alcohol vapors and sub-3 micron sized particles carried into fluid outlet 142, are carried via line 146 to a condenser 148. Cooling water is received from a cooling tower 150 and passed through the condenser 148 by way of lines 152 and 154 to condense the alcohol vapors according to techniques well known to one of ordinary skill in the art. The sub-3 micron sized particles suspended in the alcohol vapor are slurried in the condensed alcohol. The newly formed slurry is removed from the condenser by line 156 and may be transferred by line 156 to either a fuel utilization area for direct and immediate use or further processing.

The essential difference between the slurry obtained from condenser 148 and the slurry obtained from the blend tanks 70, 72 is that a substantial majority of the inorganic ash forming minerals and organic and inorganic forms of sulfur present in the original coal solids have been removed from the slurry of condenser 148, thereby providing, for example, a substantially clean transportation fuel available for use without the need of further pollution control equipment. For example, whereas 100,000 pounds of the 51% slurry obtained from the original blend tank 70, 72 would have substantially the following composition: methanol 49,000 pounds; hydrocarbonaceous components 37,200 pounds; water 2500 pounds; mineral components 10,200 pounds; and total sulfur 1100 pounds, by way of contrast 100,000 pounds of the slurry derived from condenser 148 and the process of this invention would have the following composition: methanol 55,234 pounds; hydrocarbonaceous components 40,675 pounds; water 2818 pounds; mineral components 1150 pounds; and sulfur 124 pounds, with the substantial majority (90%) of mineral components and total sulfur (now combined with the sulfur scavenging agent) removed by the cyclone 140.

Between about 95 and 98 percent of the hydrocarbonaceous matter in the original coal has been retained in the product slurry or solution with the methanol while between about 70 and about 95 percent of the mineral matter and between about 80 and about 100 percent of the total sulfur has been removed.

The slurry may be used directly as a fuel. It has a combustion value of between about 94,000 and about 110,000 BTU per gal, an increase of between about 24,000 and about 34,000 BTU per gal or between about 33 and about 46 percent over the pure methanol. Fuel value is relatively equally divided between coal and methanol in the product. In an alternate approach the methanol would be at least in part stripped from the hydrocarbonaceous portion, leaving the hydrocarbonaceus portion as a clean fuel or chemical feedstock. The recovered methanol would be recycled through the invention.

Returning to cyclone 140 of FIG. 2, the underflow or particles greater than about 3 microns in diameter are recovered from cyclone 140 at particle outlet 144 and are passed through a line 158 to a scavenger regenerator 160. The underflow preferably includes the total sulfur in solid metallic sulfide form as well as the other mineral components. There is sufficient energy through combustion of the scavenger metal sulfides and the coal particles larger than 3 microns to generate enough heat to raise the temperature of stream 158 to about 1000° F. at the point where stream 158 enters the scavenger regenerator 160.

The regenerator 160 includes a fluidized bed reactor and introduces an oxygen containing gas, e.g., air, to the reactor through line 162 according to techniques well known to one of ordinary skill in the art. The metal sulfides combine with the oxygen at conditions sufficient to produce additional combustion. The resulting regeneration unit 160 produces a stream of hot exhaust combustion gases 118 at a temperature of about 1500° F. and a stream of regenerated sulfur scavenger 164 at about 130° F. These combustion gases 118 are primarily nitrogen, carbon dioxide, air and sulfur in the form of sulfur dioxide. This combustion gas stream 118 is directed to heat exchanger 116 to provide a highly energy efficient process, as previously explained, and exits the exchanger through line 120 at about 500° F. It can then be directed to a sulfur recovery unit for further processing, if desired. Fully oxidized coarse mineral particles—primarily $Fe_2O_3$—exit through line 164 at the bottom of the reactor. The predetermined required amounts of sulfur scavenger are recycled back to the expansion unit through line 136. Surplus $Fe_2O_3$ resulting from the pyrite in the mineral matter of the feed coal are removed by line 166 and directed to storage.

The smaller, less dense, ash forming mineral particles are removed from the middle of the reactor by line 168. This mineral matter is cooled in the quench pond 170 and removed by line 172 to disposal facilities.

The temperature of the gas stream 118 can be increased, for example, by increasing the amount of hydrocarbonaceous matter allowed into the regenerator 160. However, by reducing the amount of such hydrocarbonaceous matter to a minimum, the method can be maintained highly energy efficient without diminishing the energy value of the hydrocarbonaceous product obtained from the method.

The foregoing description has made reference to a preferred embodiment of the invention, describing preferred operating conditions in connection therewith. However, a more general description of the invention has been given elsewhere in the specification such that the invention is not to be limited by the detailed description of the preferred embodiment. In particular, the scope of the present invention is not to be limited beyond the following claims and their equivalents.

What is claimed is:

1. A method for separating a porous hydrocarbonaceous solid containing an admixture of hydrocarbonaceous components and nonporous mineral components into a hydrocarbonaceous enriched fraction and a mineral enriched fraction which comprises (a) comminuting the hydrocarbonaceous components of the hydrocarbonaceous solid selectively in the presence of a low molecular weight monohydric alcohol without substantially comminuting the mineral components therein under conditions sufficient to substantially scission the hydrocarbonaceous components from the mineral components and to produce a mixture of comminuted discrete hydrocarbonaceous particles in admixture with discrete mineral particles wherein the mean particle size of the comminuted hydrocarbonaceous particle is less than about 5 microns in diameter, and the mean particle size of the mineral particles both before and after comminution is substantially unchanged; and (b) separating the resultant product in a separation zone to provide an enriched hydrocarbonaceous fraction and an enriched mineral fraction.

2. A method according to claim 1 wherein between about 70 and about 95 percent by weight of said mineral components in said hydrocarbonaceous solid are removed from said hydrocarbonaceous solid to further define said hydrocarbonaceous enriched fraction.

3. A method according to claim 1 wherein the porous hydrocarbonaceous solid is comminuted by providing a slurry of the hydrocarbonaceous solid in the lower molecular weight alcohol at a temperature and pressure in excess of the critical pressure and temperature of the alcohol; and, rapidly reducing the pressure imposed on the slurry, thereby causing the liquid to expand explosively and thereby comminute selectively the hydrocarbonaceous components in the solid.

4. A method according to claim 1 wherein the porous hydrocarbonaceous component is comminuted into a shattered product having a volumetric mean particle size of less than about 5 microns in diameter, by:

(a) preparing a slurry of a lower molecular weight alcohol and the hydrocarbonaceous solid;

(b) raising the pressure imposed on said slurry to a pressure above the critical pressure of the alcohol to force alcohol into the pores of the solid;

(c) raising the temperature of the slurry to a temperature above the critical temperature of the alcohol to convert the alcohol into a supercritical fluid;

(d) maintaining the slurry above the critical temperature and pressure of the alcohol for a length of time sufficient to permit the supercritical fluid to substantially saturate the pores of the solid; and (e) substantially instantaneously reducing, in an expansion zone, the pressure imposed on said slurry to a second lower pressure to provide a pressure differential between the supercritical fluid within the solids and the surface of the solids sufficient to provide the shattered product.

5. The method according to claim 4 wherein said discrete hydrocarbonaceous particles include a subfraction consisting essentially of hydrocarbonaceous particles substantially free of sulfur and having a volumetric mean particle size of less than about 2 microns in diameter.

6. The method of claim 4 wherein said lower molecular weight alcohol is selected from the group consisting of methanol, ethanol and propanol and said hydrocarbonaceous solid is coal.

7. The method according to claim 6 wherein said pressure above the critical pressure of the alcohol is between about 3,000 psia and about 15,000 psia.

8. The method according to claim 6 wherein said temperature above the critical temperature of the alcohol is between about 700° F. and about 850° F.

9. The method according to claim 6 wherein said pressure above the critical pressure of the alcohol is between about 3,000 psia and about 15,000 psia and said temperature above the critical temperature of the alcohol is between about 700° F. and about 850° F.

10. The method according to claim 4 wherein said slurry is maintained at supercritical conditions for less than about 5 minutes.

11. The method according to claim 4 wherein the pressure in the expansion zone is substantially ambient pressure and the temperature in the expansion zone is maintained at a temperature higher than the dew point of the vapor at the pressure of the expansion zone.

12. The method according to claim 11 wherein said temperature is about 200°–275° F.

13. The method according to claim 4 wherein the pressure imposed on the slurry is reduced to the second pressure in less than about 10 microseconds.

14. The method according to claim 13 wherein said time is less than about 1 microseconds.

15. The method according to claim 14 wherein said time is less than about 0.1 microsecond.

16. The method of claim 1 wherein said hydrocarbonaceous solid is coal.

17. A method for comminuting the hydrocarbonaceous material within a porous hydrocarbonaceous solid containing mineral matter into a shattered product which comprises (a) preparing a slurry of a lower molecular weight monohydric alcohol and the hydrocarbonaceous solid;

(b) raising the pressure and temperature imposed on the slurry to a pressure and temperature above the critical temperature and pressure of the alcohol to force alcohol into the pores of the solid and to convert the alcohol into a supercritical fluid;

(c) maintaining the slurry above the critical temperature and pressure of the alcohol for a length of time sufficient to permit the supercritical fluid to substantially saturate the pores of the solid; and (d) substantially instantaneously reducing the pressure imposed on said slurry to a second lower pressure to provide a pressure differential between the supercritical fluid within the solids and the surface of the solids sufficient to cause the solids to shatter and to provide said shattered product.

18. The method according to claim 17 wherein said lower molecular weight alcohol is selected from the group consisting of methanol, ethanol and propanol and said hydrocarbonaceous solid is coal.

19. The method according to claim 18 wherein said pressure above the critical pressure is between about 3,000 and about 15,000 pounds per square inch absolute.

20. The method according to claim 18 wherein said temperature above the critical temperature is between about 700° F. and about 850° F.

21. The method according to claim 18 wherein said pressure above the critical pressure is between about 3,000 psia and about 15.000 psia and said temperature above the critical temperature is between about 700° F. and about 850° F.

22. The method according to claim 17 wherein said slurry is maintained at supercritical conditions for less than about 5 minutes.

23. The method according to claim 17 wherein the pressure in the expansion zone is substantially ambient pressure and the temperature in the expansion zone is maintained at a temperature higher than the dew point of the vapor at the pressure of the expansion zone.

24. The method according to claim 23 wherein said temperature is about 200°–275° F.

25. The method according to claim 17 wherein the pressure imposed on the slurry is reduced to the second lower pressure in less than about 10 microseconds.

26. The method according to claim 25 wherein said time is less than about 1 microseconds.

27. The method according to claim 25 wherein said time is less than about 0.1 microsecond.

28. The method of claim 17 wherein said hydrocarbonaceous solid is coal.

29. A method of treating a hydrocarbonaceous material containing an admixture of hydrocarbonaceous components and mineral components to increase the usefulness of the material as a fuel, comprising, in combination:

(a) admixing the hydrocarbonaceous material with a low molecular weight alcohol to form a slurry of alcohol and hydrocarbonaceous material;

(b) heating and pressurizing the slurry to a temperature and pressure above the critical temperature and critical pressure of the alcohol;

(c) maintaining the slurry at a supercritical temperature and pressure, prior to step (d), for a length of time sufficient to permit the alcohol to substantially saturate the hydrocarbonaceous material and achieve the desired degree of interaction with the hydrocarbonaceous components, thereby providing: (1) a dissolved portion of the hydrocarbonaceous components in alcohol; (2) an undissolved suspended portion of the hydrocarbonaceous material saturated with the alcohol; and (3) a discrete suspended portion of the mineral components;

(d) passing the slurry, in a substantially instantaneous manner, from the supercritical pressure to an expansion zone having a temperature and pressure below the critical temperature and critical pressure of the alcohol, thereby flash precipitating the dissolved portion of the hydrocarbonaceous components as discrete hydrocarbonaceous particles and providing a pressure differential between the alcohol saturating the undissolved suspended portion of the hydrocarbonaceous materials and the surface of said material sufficient to comminute the hydrocarbonaceous from the mineral components therein without substantially comminuting either the mineral components therein or the discrete undissolved suspended portion of the mineral components, thereby producing an admixture of the discrete hydrocarbonaceous particles and discrete mineral particles; and (e) separating the discrete hydrocarbonaceous particles from the discrete mineral particles in a separation zone to provide an enriched hydrocarbonaceous fraction of material and an enriched mineral fraction of material.

30. The method of claim 29 wherein the alcohol is methanol.

31. The method of claim 29 wherein the slurry is maintained at a supercritical temperature and pressure for between about 5 seconds and about 5 minutes.

32. The method of claim 29 wherein the passing of the slurry from the supercritical pressure to the expansion zone is done in a substantially instantaneous and adiabatic manner.

33. The method of claim 29 wherein between about 70 and about 95 percent by weight of the mineral components in the hydrocarbonaceous material are separated from the hydrocarbonaceous components to produce the enriched hydrocarbonaceous fraction.

34. The method of claim 33 wherein between about 85 and about 95 percent by weight of the mineral components are separated from the hydrocarbonaceous components.

35. The method of claim 29 wherein the discrete hydrocarbonaceous particles in the enriched hydrocarbonaceous fraction have a mean particle size of less than about 3 micrometers in diameter and the mean particle size of the discrete mineral particles in the enriched mineral fraction is substantially unchanged.

36. The method of claim 35 wherein the discrete hydrocarbonaceous particles have a mean particle size of between about 0.1 and about 1 micrometer.

37. The method of claim 29 wherein the slurry is heated in a substantially isochoric manner.

38. The method of claim 29 wherein the slurry is heated in a substantially isobaric manner.

39. The method of claim 38 wherein, prior to heating the slurry, the slurry is pressurized to a pressure of between about 3,000 and about 15,000 psia.

40. The method of claim 29 wherein said slurry is heated in at least 2 stages.

41. The method of claim 40 wherein said slurry is heated in a first stage to a temperature of not more than about 400° F. at a rate of between about 15 and about 40 BTU per pound of slurry per minute.

42. The method of claim 40 wherein said slurry is heated in a second stage to a temperature of between about 700° F. and about 850° F. at a rate of between about 250 and about 500 BTU per pound of slurry per minute.

43. The method of claim 29 further including contacting the slurry with a sulfur scavenging agent while the slurry is at a temperature of between about 200° F. and about 300° F. to remove sulfur from the slurry.

44. The method of claim 29 further comprising spraying a sulfur scavenging agent into the expansion zone such that the scavenging agent contacts the hydrocarbonaceous material immediately after it has passed into the expansion zone.

45. The method of claim 43 or 44 wherein the sulfur scavenging agent is selected from the group consisting of calcium oxide and iron oxide.

46. The method of claim 29 which includes treating the hydrocarbonaceous material prior to admixing with the alcohol in step (a) when the hydrocarbonaceous material has a moisture content greater than about 5% such that the moisture content of the hydrocarbonaceous material is reduced to about 5 percent by weight of the hydrocarbonaceous material.

47. The method of claim 29 wherein said enriched mineral fraction contains an enriched sulfur containing portion, said method further comprising, in combination:

(a) mixing at least a portion of said enriched sulfur containing portion with oxygen under conditions which are sufficient to at least partially combust said sulfur containing portion into gaseous combustion products; and (b) passing said gaseous combustion products through a heat recovery means for using at least a portion of the energy therein to heat said slurry during said heating step, whereby said method is made highly energy efficient.

48. The method of claim 47 wherein said enriched sulfur containing portion is separated from said enriched hydrocarbonaceous fraction prior to combining said enriched sulfur containing portion with oxygen, such that said method is made highly energy efficient without diminishing the energy value of the enriched hydrocarbonaceous portion obtained as a product from said method.

* * * * *